US005437114A

United States Patent [19]

Kuipers

[11] Patent Number: 5,437,114

[45] Date of Patent: Aug. 1, 1995

[54] APPARATUS FOR RECEIVING AND PASSING THROUGH LAUNDRY

[75] Inventor: Gerardus H. M. Kuipers, Berlicum, Netherlands

[73] Assignee: AMKO International B.V., Kerkdriel, Netherlands

[21] Appl. No.: 192,019

[22] Filed: Feb. 4, 1994

[30] Foreign Application Priority Data

Feb. 5, 1993 [NL] Netherlands ..... 9300238

[51] Int. Cl.[6] ..... D06F 67/04

[52] U.S. Cl. ..... 38/143

[58] Field of Search ..... 38/143, 8, 12; 198/571, 198/572, 575, 577, 689.1, 752; 26/87, 88, 97, 98

[56] References Cited

U.S. PATENT DOCUMENTS

| | | | |
|---|---|---|---|
| 2,585,834 | 2/1952 | Pocock | 38/143 |
| 3,470,636 | 10/1969 | Withorn | 38/143 |
| 3,756,588 | 9/1973 | Gertenberger | 38/143 |
| 4,979,868 | 12/1990 | Ueda et al. | 38/143 X |
| 4,991,326 | 2/1991 | Weir | 38/143 |
| 5,168,645 | 12/1992 | Robin et al. | 38/12 X |
| 5,172,502 | 12/1992 | Kober | 38/143 X |

FOREIGN PATENT DOCUMENTS

| | | |
|---|---|---|
| 0372320 | 6/1990 | European Pat. Off. . |
| 6405706 | 11/1964 | Netherlands . |
| 6713796 | 4/1969 | Netherlands . |
| 2251866 | 7/1992 | United Kingdom . |

*Primary Examiner*—Clifford D. Crowder
*Assistant Examiner*—Ismael Izaguirre
*Attorney, Agent, or Firm*—DeLio & Peterson

[57] ABSTRACT

Apparatus for receiving and passing through pieces of laundry, a piece of laundry being rectangular and comprising a leading edge, a rear edge and two lateral edges, the apparatus comprising a frame and or intake device on the frame for engaging a sole corner portion of the leading edge of the piece of laundry which is fed by hand, and a conveyor arranged downstream of the intake means for clamping and conveying the corner portion and the lateral edge portion following the corner portion in a smooth and straightened out condition, independent of the other lateral edge.

30 Claims, 5 Drawing Sheets

APPARATUS FOR RECEIVING AND PASSING THROUGH LAUNDRY

BACKGROUND OF THE INVENTION

1. Field of the Invention

The invention relates to an apparatus for receiving and passing through laundry.

2. Description of the Related

In laundries, clean laundry such as sheets is fed to an apparatus which automatically mangles the laundry. This apparatus for feeding and laying down washed sheets is known from Dutch patent specification no. 167.743 in the name of applicant. Therein, the operator has to put two corners of the sheet between two clamps by hand.

A drawback to this apparatus is that, after the first corner has been inserted, the entire longest edge of the piece of laundry has to be searched or guided to find the second corner, in order to put it in the second clamp. This is very time-consuming.

It is an object of the present invention to obviate this drawback.

SUMMARY OF THE INVENTION

For this purpose the apparatus according to the invention was developed, which apparatus achieves this object with the measure, that the apparatus comprises intake means that require only one corner of a piece of laundry to be fed by hand, and conveyor means to convey a side edge from the corner of the piece of laundry in a stretched condition.

Because only one corner of the piece of laundry need now be fed, after which the conveying means convey a side edge from the corner of the piece of laundry, a considerable shortening of the cycle time for feeding is obtained.

The intake means preferably comprise orientating means and control means which steer a side from the corner of the piece of laundry along a substantially straight line. Hereby, the clamps can easily be placed further on, for instance by feeding the side to a clamp placing mechanism.

According to an embodiment of the apparatus, the apparatus comprises a frame, belt conveyor means and a drive mechanism for the belt conveyor means, and the orienting means comprise steering rollers and members to bring the steering rollers into contact with the piece of laundry, the steering rollers being actuated by the control means, to pass the piece of laundry through in such a way, that the side of the piece of laundry runs along a substantially straight line after a front edge area of the piece of laundry has been fed into the apparatus.

According to a further embodiment the belt conveyor means comprise front belt conveyor means and rear belt conveyor means, the belt conveyor means being arranged to clamp the piece of laundry, the rear belt conveyor means protruding forwards from below the front belt conveyor means, the rear belt conveyor means comprising a rear endless conveyor belt, wherein engagement means for the piece of laundry are placed at the forwardly protruding portion of the rear belt conveyor means, said engagement means preferably comprising at least one pressure roller, resting on the rear conveyor belt, to press a front edge area, preferably a front edge area spaced from the vertex of the corner, and following areas of the piece of laundry onto the forwardly protruding portion of the rear conveyor belt.

According to yet a further embodiment the intake means comprise a loading table having placed therein a right-hand rear steering roller and left-hand rear steering roller, a right-hand front steering roller and a left-hand front steering roller, the right-hand and the left-hand steering rollers being positioned opposite each other in pairs and the front steering rollers being suspended and liftable independently from the rear steering rollers, and each pair of steering rollers defining an equal but opposite angle with regard to the perpendicular on the longitudinal direction of the belt conveyor means, and wherein the control means comprise an edge photocell and command means for the steering rollers.

It is remarked that it is known in itself to guide long strips, such as paper strips, by means of pairs of steering rollers. In that case, however, a pair of rollers is positioned on each edge of the strip, the rollers, each on one side, having a bearing in a support block. As a consequence thereof, the strip cannot run between the rollers on both sides of both pairs of rollers.

In a more detailed embodiment, the edge photocell is arranged adjacent to the rollers in the loading table, where the side of the piece of laundry will run, in front of the protruding portion of the rear belt conveyor means and the edge photocell actuates the command means to cause a pair of rollers to cover the edge photocell again with the edge of the piece of laundry if the edge photocell is not covered and to cause the other pair of rollers not to cover the edge photocell again with the edge of the laundry if the edge photocell is covered.

According to a further embodiment the command means comprise a left-hand electromagnet with compression spring for the left-hand pair of steering rollers and a right-hand electromagnet with compression spring for the right-hand pair of steering rollers and pressure means for the front steering rollers, the edge photocell alternately opening the right-hand pair of steering rollers and the left-hand pair of steering rollers during reception of the piece of laundry, by means of the respective electromagnets. The electromagnets with compression spring are preferably arranged onto the rear steering rollers.

According to a preferred embodiment at least one activating photocell, and preferably two activating photocells spaced sideways from one another, is/are placed in the loading table to start the belt conveyor means when the activating photocell is covered if the edge photocell is also covered. As a consequence hereof, the apparatus will start automatically.

The activating photocell preferably actuates the pressure means to lift the front steering rollers when the activating photocell is no longer covered by the piece of laundry. As a consequence hereof, the intake means are immediately capable of receiving a new piece of laundry.

According to a preferred embodiment the opposite angles of the respective pairs of steering rollers with regard to the perpendicular on the longitudinal direction of the belt conveyor means are between 0° and 45°, preferably 25°.

The intake means steer the side of the piece of laundry in an advantageous manner after the at least one activating photocell has been covered for a certain, pre-settable time. Hereby, the first corner of the piece of laundry can be securely held.

According to a further embodiment, a forwardly protruding curved guide rod is placed near the lower edge of the loading table for smoothing the creases present in the piece of laundry, which guide rod protrudes sidewards from the rear conveyor belt on the side opposite the side, where the side edge of the piece of laundry will run. During conveyance, the piece of laundry will slide over this guide rod before it reaches the loading table, as a consequence of which any creases that may be present are smoothed from the piece of laundry.

According to a preferred embodiment there are placed, preferably below the loading table, spaced from the piece of laundry's edge which is to be conveyed, discontinuously operating supporting means for supporting the freely depending portion of the piece of laundry, if the piece of laundry is wider than the belt conveyor means. These supporting means assist the freely depending portion of the piece of laundry, which is hanging down next to the fed corner of the piece of laundry, during the upward conveyance, in that they discontinuously assist the freely depending portion of the piece of laundry in moving upwards.

Moreover, the supporting means spread the piece of laundry sidewards in an advantageous manner whereby the piece of laundry, which could have the tendency to shift as a consequence of the weight of the freely depending portion, is once more spread.

According to a preferred embodiment the supporting means comprise a supporting member with one or more spread cams, which move upwards at an oblique angle during operation of the supporting means, whereby the spread cams move the piece of laundry upwards as well as spread it.

An advantageous embodiment is obtained when the supporting member is a rotatable cam table of which the corners form the spread cams, the cam table preferably being essentially triangular, and wherein the cam table, seen in a plane parallel to the front belt conveyor means, is preferably upwardly inclined under an angle of 15° with regard to the horizontal. Hereby, one corner of the cam table will each time function as spread cam and help the piece of laundry upwards and spread it, when the cam table rotates one-third of a revolution.

In order to place one or more clamps on the piece of laundry, the apparatus comprises clamp placing means. By means of these, clamps are automatically placed on the piece of laundry.

The clamp placing means comprise a clamp placing unit and clamp control means. According to an embodiment the front belt conveyor means comprise a front endless conveyor belt and a front endless insert belt, the front insert belt being placed alongside the front conveyor belt, and the rear endless belt conveyor means comprising a rear endless insert belt, placed alongside the rear conveyor belt, the insert belts being essentially brought into contact with each other in order to guide and to clamp the side of the piece of laundry, the insert belts being shorter than the conveyor belts.

According to a further embodiment the clamp placing unit is placed at the exit point of the insert belts and the clamp control means comprise a clamp photocell to spot the piece of laundry and to activate the clamp placing unit.

According to a preferred embodiment the clamp placing unit comprises a buffer rail with supplied clamps, and a pivotable arm which can fetch a clamp, while opening the clamp, and the clamp photocell actuates the pivotable arm to place the clamp onto the edge of the piece of laundry.

It is preferred that the clamp placing unit comprises a pneumatic cylinder for pivoting the pivotable arm, and comprises a pneumatic cylinder for opening and closing the clamp. Two guide plates are placed between the insert belts and the path of the clamps in an advantagous manner to guide the edge of the piede of laundry. Hereby, the edge of the piece of laundry is fed into the clamp placing unit correctly.

It is preferred that blower means are provided adjacent to the guide plates to establish an air current to keep the edge of the piece of laundry stretched.

An advantageous embodiment of the apparatus is obtained if the apparatus is arranged substantially vertically, so that the apparatus occupies little floor space.

With this apparatus it becomes possible to receive and pass through laundry, only one corner of a piece of laundry needing to be fed by hand, and a side edge from the corner of the piece of laundry being conveyed in a stretched condition by conveying means, in order to handle the piece of laundry further on.

BRIEF DESCRIPTION OF THE DRAWINGS

The invention will be described hereafter by means of a preferred embodiment, with reference to the accompanying drawings.

DESCRIPTION OF THE PREFERRED EMBODIMENT

Figure 1:
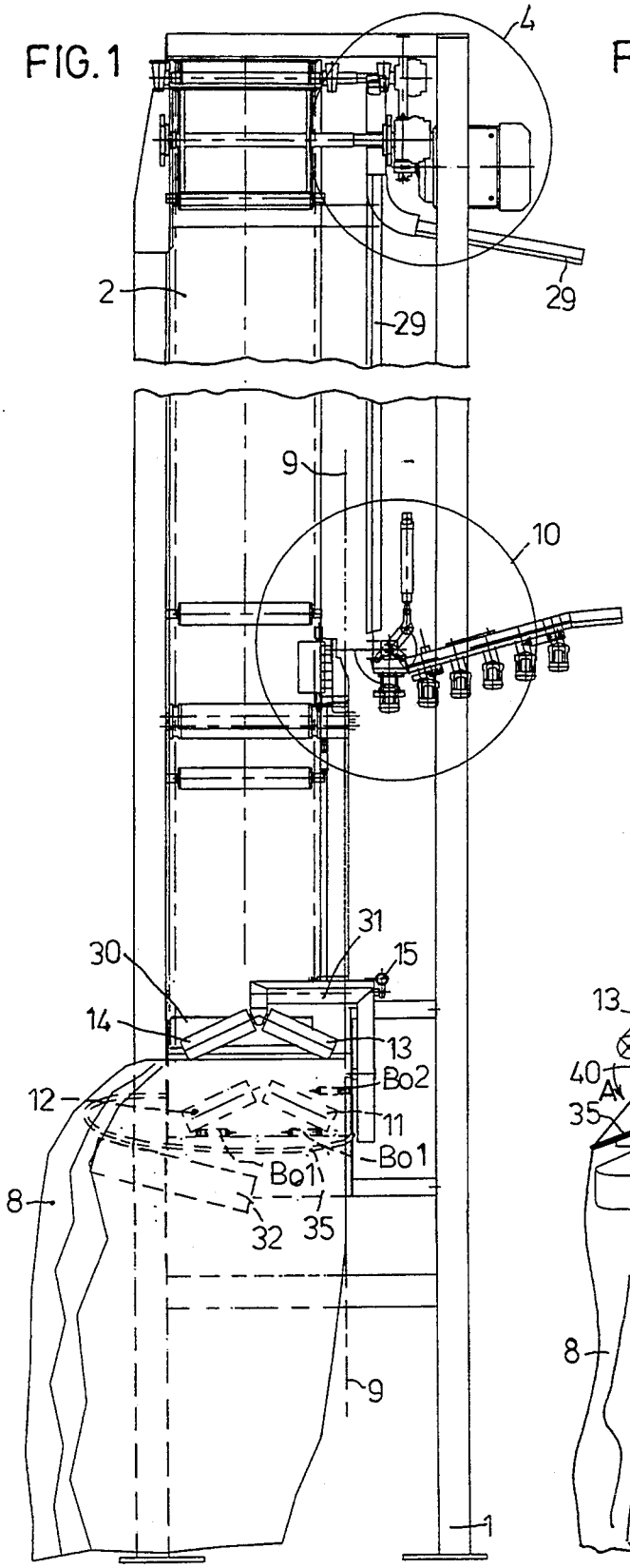
FIG. 1 presents a schematical front view of a preferred embodiment of the apparatus according to the invention.
Figure 2:
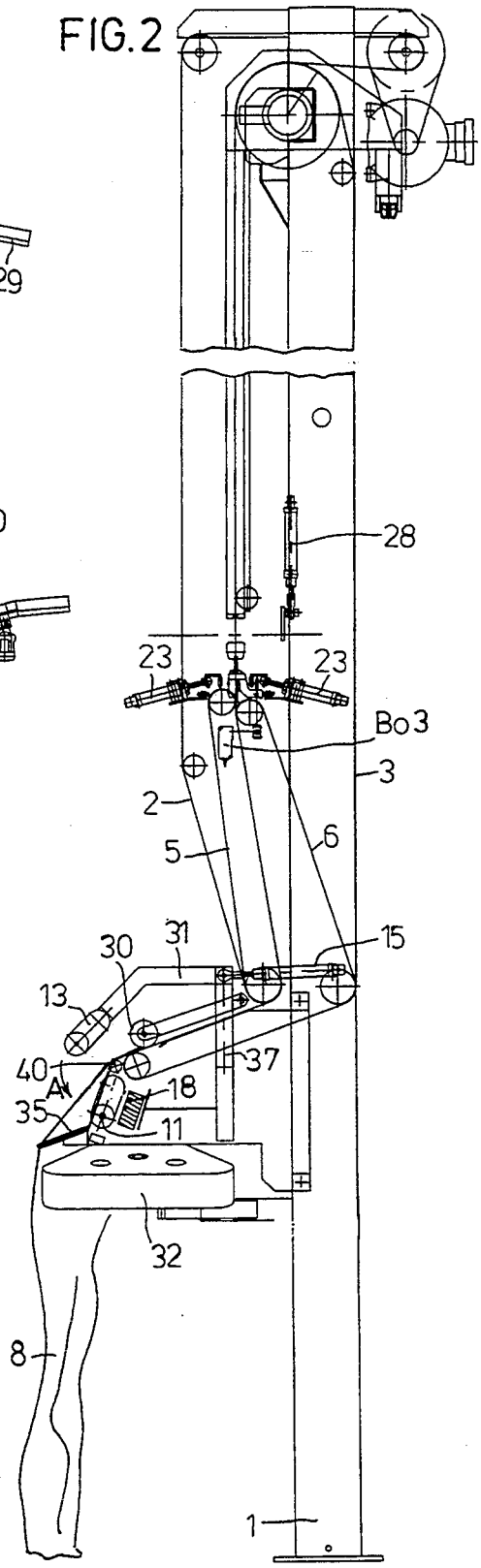
FIG. 2 presents a side view of the apparatus according to FIG. 1.
Figure 4:
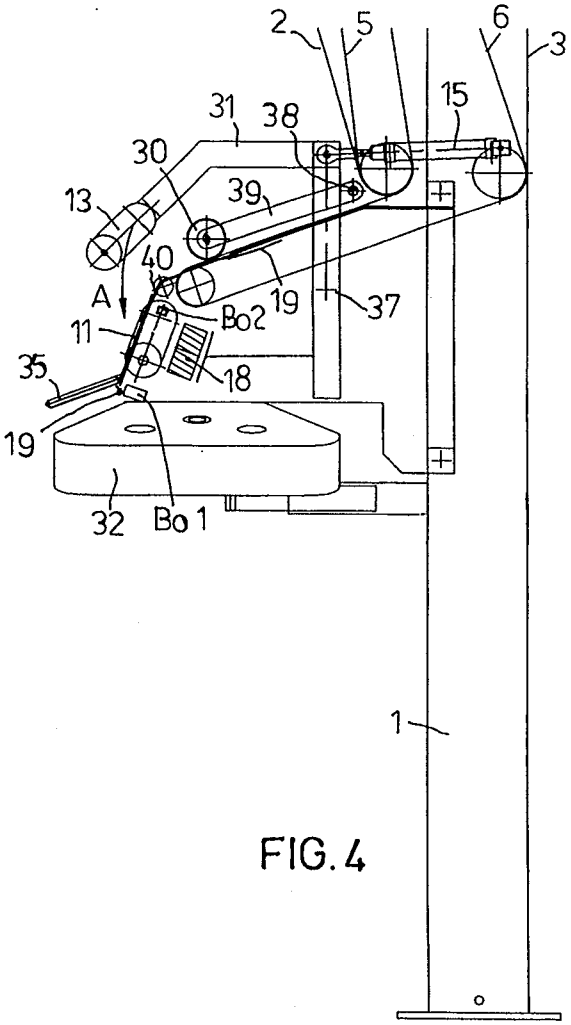
FIG. 4 presents a side view of the intake means according to FIG. 3.

FIGS. 1 and 2 show the preferred embodiment of the invention. A frame 1 stands on the ground by means of legs. A front endless conveyor belt 2 and a rear endless conveyor belt 3 run substantially vertically and are actuated by a driving mechanism, generally indicated by 4. The lower portion of the rear endless conveyor belt 3 protrudes both forwards from below the front conveyor belt 2 over a length of about 50 cm and downwards under an angle of 20° with the horizontal. An equally wide pressure roll 30 rests on this lower portion, said pressure roll 30 being hinged around axis of rotation 38 by means of arms 39. The conveyor belts are 360 mm wide and have to clamp the piece of laundry between them and pass it upwards. In order to be able to place clamps 21, the piece of laundry should substantially run along the imaginary intake line 9. For this purpose intake means are present. These intake means have been indicated in greater detail in FIGS. 3 and 4.

A loading table 19 is placed at the lower end of the rear endless conveyor belt 3. The top portion of the loading table rests under the upper surface of the forwardly protruding portion of belt 3 to support it. From the front edge of belt 3 the loading table 19 extends substantially vertically downwards. On the transition of the top and the lower portion of the loading table 19 a smooth freely rotating roller 40 has been provided, which roller protrudes somewhat from the loading table. In the lower portion of the loading table 19 a right-hand rear steering roller 11 and a left-hand rear steering roller 12 are placed, which protrude forward somewhat from the back plate. A right-hand front steering roller 13 and a left-hand front steering roller 14, respectively, are placed opposite these rollers, both rollers 13, 14 being suspended on an arm 31. The steering rollers are not parellel to the end rollers for the conveyor belts, but the right-hand pair is positioned under a downward angle of 25° towards the right and the left-hand pair is positioned under a downward angle of 25° towards the left.

A pneumatic cylinder 15 can press the front steering rollers 13, 14 against the rear steering rollers 11, 12, or lift them, by means of the arm 31, which rotates around the centre of rotation 37. This happens once with each piece of laundry. Electromagnets with compression springs 17, 18 are provided on the respective rear steering rollers 11, 12. An electromagnet with compression spring can quickly withdraw the corresponding rear steering roller over a distance of about 3 mm. In this situation, the front steering rollers are tightly secured to the arm 31.

Alternatively, the electromagnets with compression spring can be provided on the respective front steering rollers 13, 14. An electromagnet with compression spring may then quickly lift the corresponding front steering roller over a distance of about 3 mm.

The rollers are covered with a mohair covering. It has been found that a pressure force of 27.5 N provides the best results.

A curved guide rod 35 has been provided near the lower edge of the loading table 19, which guide rod protrudes in front of the loading table and protrudes sidewards where the freely depending portion of a wide piece of laundry will hang.

Figure 3:
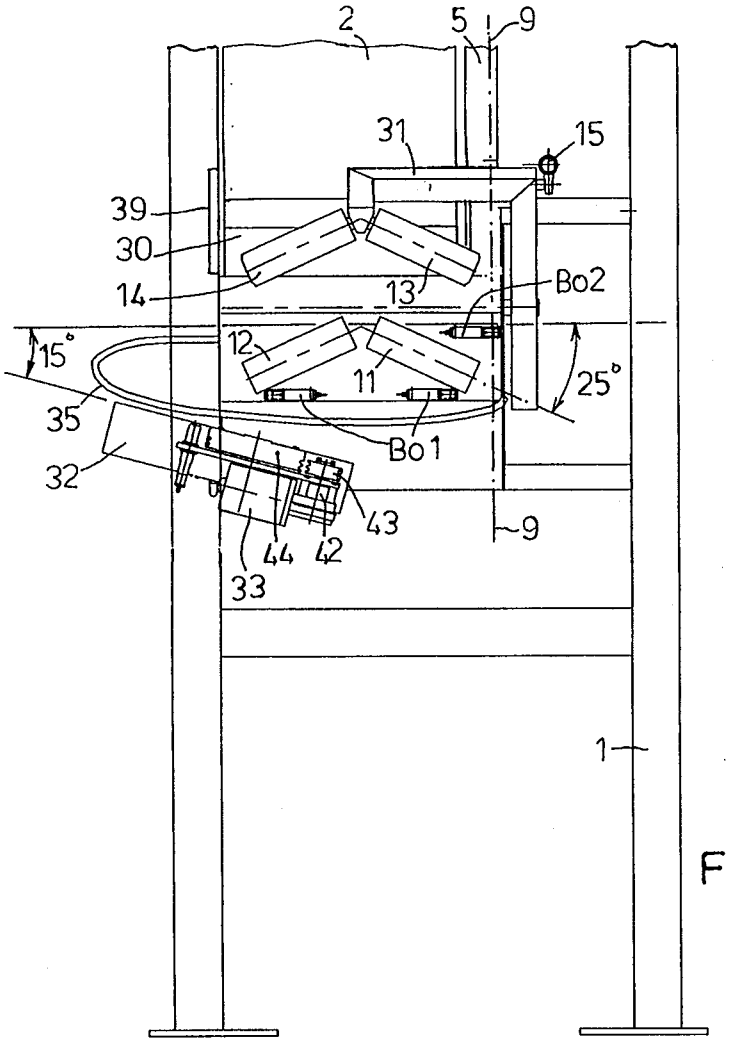
FIG. 3 presents a schematical front view of the intake means in the apparatus according to FIG. 1, on a larger scale.

A triangular cam table 32 is provided below the loading table 19, of which cam table the corners form three cams 45. The cam table is placed at the side of the conveyor belts, where the freely depending portion of a wide piece of laundry will hang. The cam table is actuated intermittently by a direct-current motor 33, which actuates the cam table deceleratedly via transmission 42, pulley 43 and pulley 44. When the cam table is not in motion, the current front side of the cam table lies in the same vertical plane as does the relevant portion of guide rod 35 which is placed above the cam table. Seen from above (FIG. 8) the cam table rotates clockwise. Three holes 36 are provided in the cam table, and an inductive reader 34 has been placed under it. After the cam table has been partially rotated the motor stops as soon as a hole 36 is detected by the reader 34. Seen in a plane parallel to the front conveyor belt, cam table 32 is upwardly inclined under an angle of 15° with the horizontal (FIG. 3).

Two activating photocells B01 are provided under the pairs of rollers and an edge photocell B02 is provided in the input table 19 on the right of the pair of rollers.

In order to convey the side of the piece of laundry properly towards the clamp placing means, a front insert belt 5 and a rear insert belt 6 are provided alongside the lower portions of the conveyor belts 2, 3. These insert belts clamp the side of the piece of laundry. They can be seen most clearly in FIGS. 2 and 4. These insert belts have a width of 50 mm and are positioned immediately above the edge photocell B02. The front insert belt 5 extends equally far downwards as does the front conveyor belt 2, and the rear insert belt 6 extends equally far downwards as does the rear conveyor belt 3.

Close to the front conveyor belt and the front insert belt a security plate (not shown) is provided across the entire width of the input table, which security plate causes the belts to stop immediately upon contact.

Figure 6:
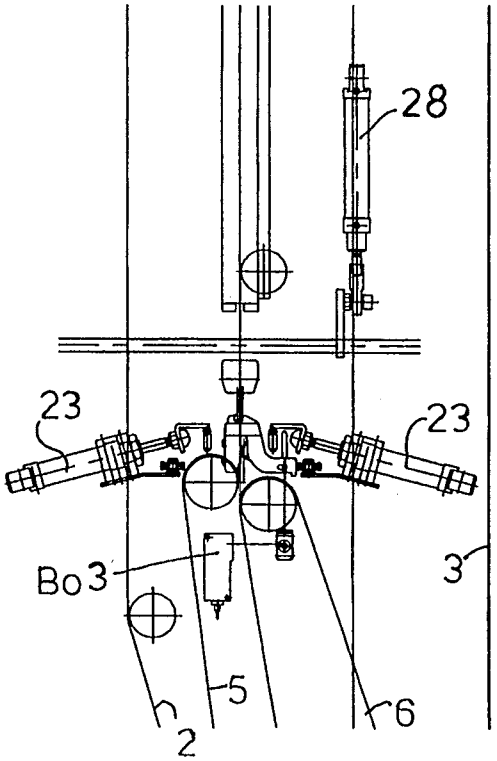
FIG. 6 presents a side view of the clamp placing means according to FIG. 5.
Figure 5:
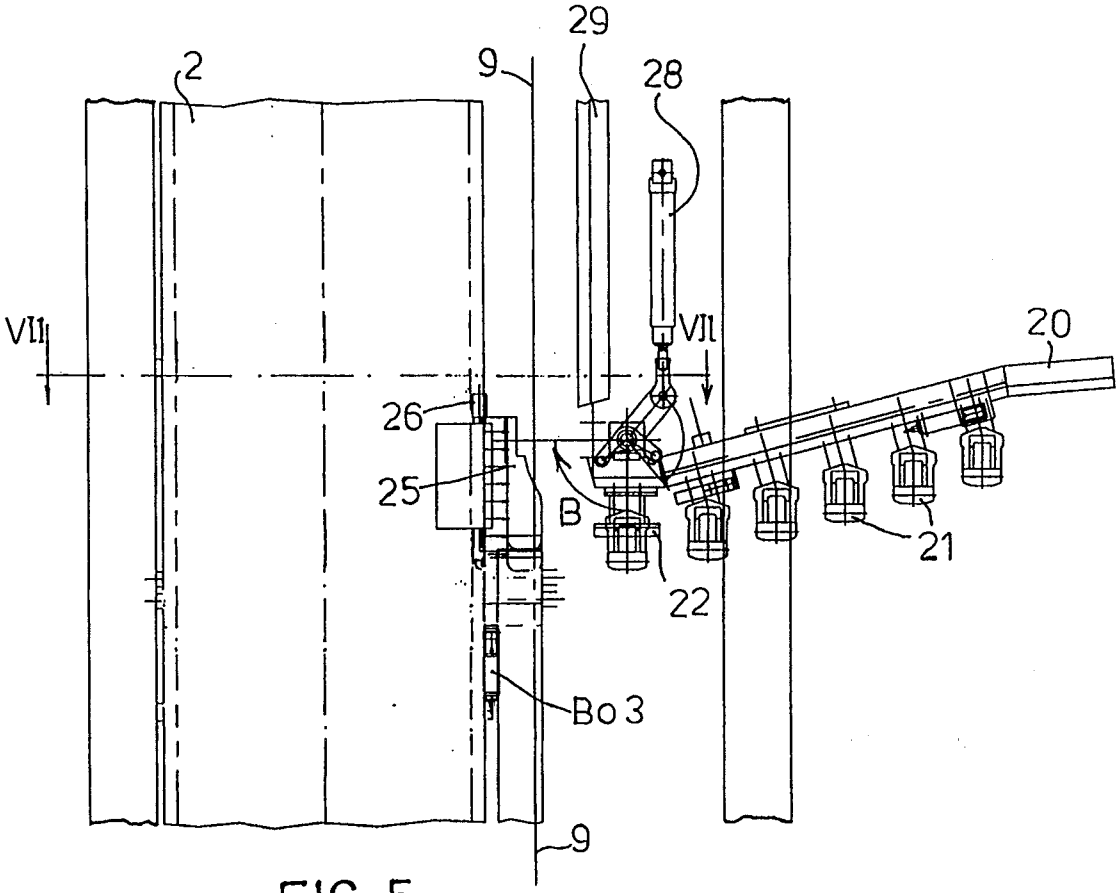
FIG. 5 presents a schematical front view of the clamp placing means according to FIG. 1, on a larger scale.
Figure 8:
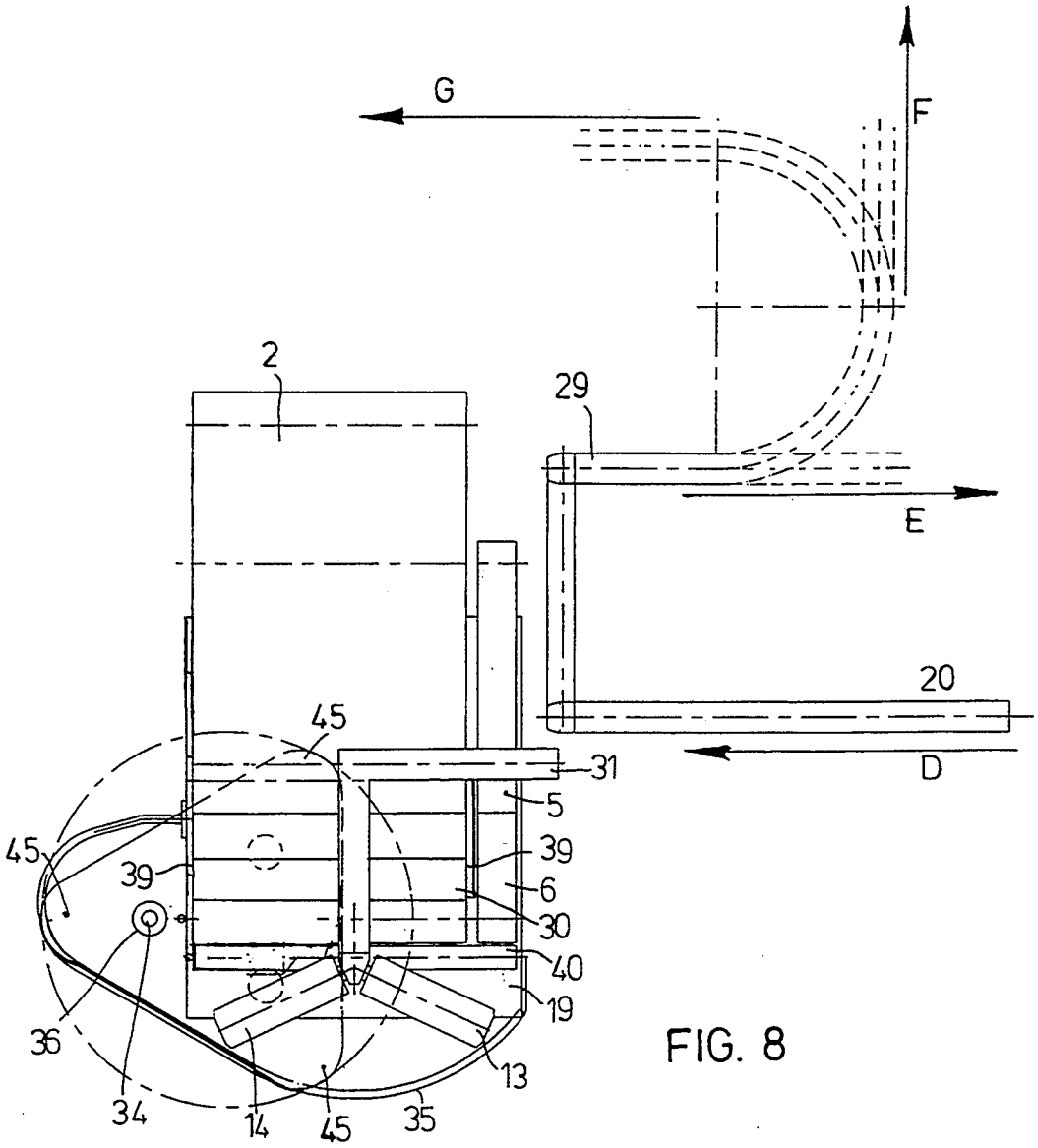
FIG. 8 presents a simplified top view of the apparatus according to FIG. 1.

The insert belts 5, 6 are shorter than the conveyor belts 2, 3. The clamp placing unit 10 has been placed at the position where the insert belts end. The clamp placing unit 10 is shown in more detail in FIGS. 5 and 6. The clamp placing unit comprises a pivotable arm 22, with can fetch a special clamp 21 from the buffer rail 20 and can pivot it to the position on the imaginary intake line 9. The clamps 21 are supplied along arrow D (FIG. 8). The pivotable arm 22 is operated by means of a pneumatic cylinder 28. One of two pneumatic cylinders 23 opens and closes the clamp 21 at the right moment. This moment is determined by a clamp photocell B03, which also controls the pivotable arm 22.

Figure 7:
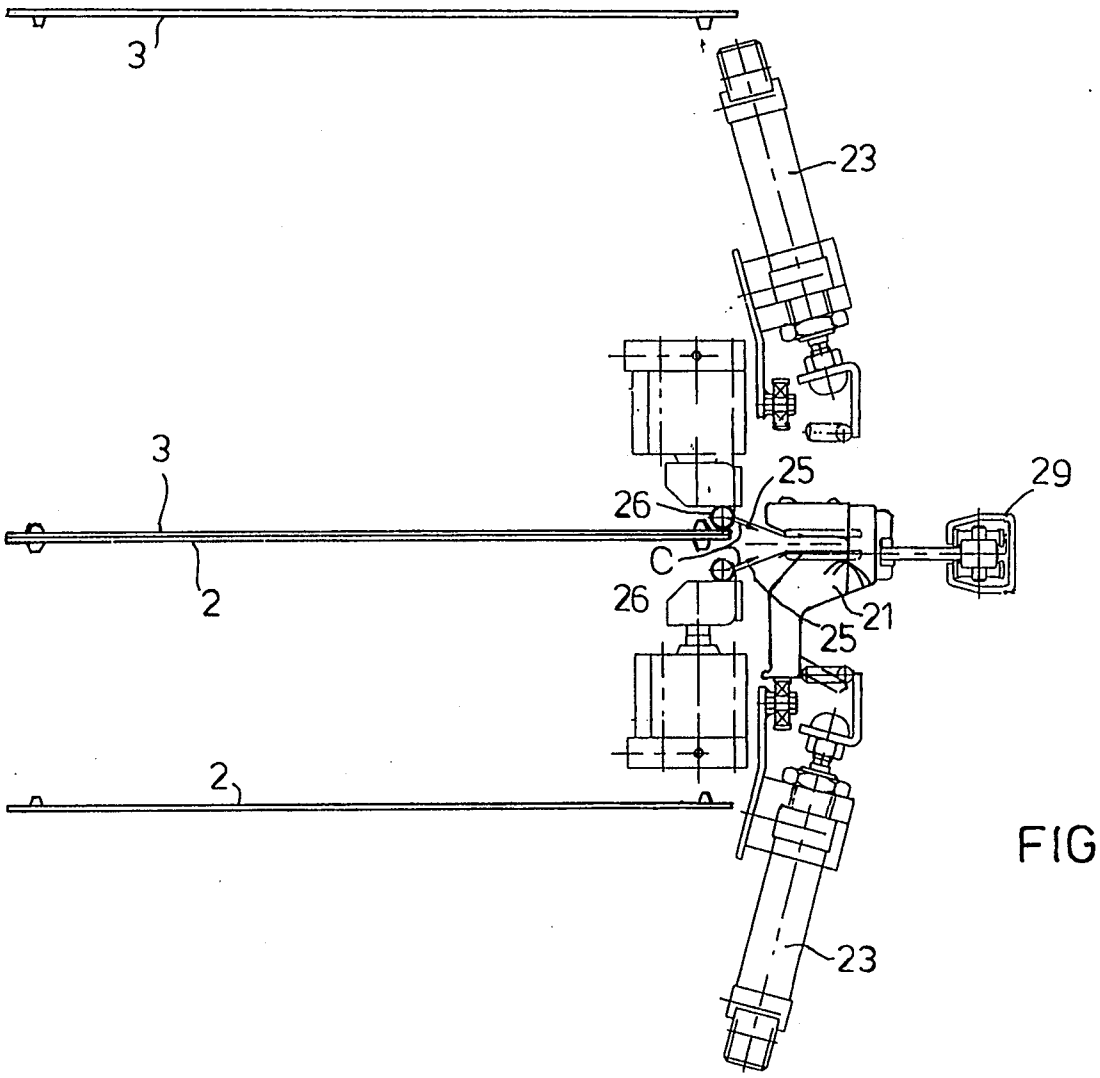
FIG. 7 presents a cross-section of the apparatus seen in FIG. 5 along the line VII—VII on a bigger scale.

Two guide plates 25 are provided between the top end of the insert belts 5, 6 and the placing position of the clamps 21 to guide the edge of the piece of laundry, where an air current is blown through (arrows C in FIG. 7) by means of blow-pipes 26 to keep the edge of the piece of laundry stretched and to reduce friction. This can be seen clearly in FIG. 7.

After the clamps have been placed, they run on over the rail system 29, and they may be conveyed to different directions (arrows E, F, G in FIG. 8), according to choice.

The apparatus works in the following manner. In the starting situation the front steering rollers 13, 14 are lifted and the belts 2, 3, 5, 6 are stationary. A piece of laundry 8 is laid down with a short side leading on the upper side of the protruding portion of the rear conveyor belt 3 and rear insert belt 6, and is conveyed under pressure roller 30 in such a way, that the side of the piece of laundry is positioned more or less against the imaginary intake line 9. Because the pressure roller is as wide as the rear conveyor belt 3, the hands of an operator can get to both sides of the feed roller, and the operator can convey the piece of laundry under the pressure roller and can put the corner point of the piece of laundry on the correct spot on the rear insert belt. The central supporting arm 31 for the front steering rollers 13, 14 ensures that the latter are not in the way when feeding the piece of laundry.

The driving mechanism 4 makes the belts 2, 3, 5, 6 run with a speed of 18 meters/minute when both the edge photocell B02 and at least one activating photocell B01 are covered (the piece of laundry will then also be received and passed through if one of the activating photocells B01 is not covered by, for instance, a hole or a tear in the piece of laundry).

After the piece of laundry has been conveyed under the pressure roller over a length of about 10 cm, the intake means are actuated. The front steering rollers 13, 14 are pressed against the rear rollers 11, 12 by the pneumatic cylinder 15 (arrow A in FIG. 2 and 4). When the edge photocell B02 is now not covered, the left-hand rear steering roller 12 is withdrawn a short way by the left-hand electromagnet 17. As a consequence hereof the right-hand pair of steering rollers 11, 13 will steer the piece of laundry to the right. Consequently, the edge photocell B02 is covered. Thereby, the left-hand electromagnet 17 is deactivated, so that the left-hand rear steering roller 12 will once again clamp the piece of laundry and the right-hand rear steering roller 11 is simultaneously withdrawn a short way by the right-hand electromagnet 18. As a consequence hereof, the left-hand pair of steering rollers 12, 14 now steers the piece of laundry to the left. Consequently, the edge photocell B02 is no longer covered, whereby the left-hand rear steering roller 12 is withdrawn and the right-hand rear steering roller 11 is clamped and the cycle repeats itself.

There is therefore no optimum position for the side of the piece of laundry, but instead a zigzag frequency is obtained with an amplitude of about 5 mm. This is sufficiently exact to be able to place the clamps 21.

After about 30 cm of the piece of laundry has been received, and a front edge of the piece of laundry is positioned between the conveyor belts and between the insert belts, the drive mechanism makes the belts run at a speed of 72 meters/minute.

In actual practice, it has been found that the piece of laundry has a tendency to move to the right as a consequence of the weight of the freely depending portion (on the left in FIG. 1). For that reason the cam table 32 is placed under the guide rod 35, which smooths creases present in the piece of laundry. During the fast conveyance of the piece of laundry the cam table rotates one-third of a revolution once or several times, depending on the length of the piece of laundry. Hereby, the piece of laundry is lifted for a short period and is brushed to the left, the laundry being spread simultaneously. The one-third of a revolution is executed in aproximately $\frac{3}{4}$ seconds and after that the cam table will remain motionless for approximately the same duration. If edge photocell B02 remains covered for too long, the cam table will immediately rotate another one-third of a revolution. When the activating photocells B02 become uncovered, the cam table is switched off (at the end of its partial rotation).

The clamp photocell B03 detects the piece of laundry and makes the rotatable arm 22 with opened clamp 21 pivot from the vertical position of rest to the horizontal placing position (arrow B in FIG. 5), as soon as the corner of the piece of laundry is in the placing position. This is done to ensure that the clamp does not hinder the corner of the piece of laundry but that it rather stretches it tight. One of the two pneumatic cylinders 23 closes the clamp and the piece of laundry moves on, the clamp being taken along over the rail system 29.

Immediately after the first clamp has been placed, the rotatable arm 22 fetches a second clamp and turns it in an open condition towards the placing position, so that the last portion of the side of the piece of laundry is pulled through the clamp, which thereby stretches the side tight. The clamp photocell B03 detects the lower edge of the piece of laundry and has the second clamp placed. If the pivotable arm with the second clamp is not yet in the placing position before the second corner of the piece of laundry is present, the belts 2, 3, 5, 6 are stopped for a short period so that a portion of the side of the piece of laundry is always pulled through the clamp.

The clamps can be placed while the piece of laundry is not in motion or while the piece of laundry is slowly being conveyed.

As soon as the activating photocell B01 is no longer covered, the pneumatic cylinders 15, 16 automatically lift the front steering rollers 13, 14. A next piece of laundry can be fed directly if belts 2, 3, 5, 6 are also stopped.

In this way a next piece of laundry may already be fed while the second clamp is yet to be placed on the preceding piece of laundry.

As a consequence hereof, a cycle time of 4.5 seconds for an average single sheet is reached, so 800 pieces/-hour per operator are obtainable. By placing two of these apparatus in mirror-fashion next to each other or behind each other, one mangling machine can be provided with sufficient laundry.

With this apparatus it is possible that even laundry which is fed in a non-aligned manner will immediately be corrected, provided that the skewness is clearly less than 25°. Folded sides and twisted lower sides are automatically vibrated out of the laundry as a consequence of the zigzag frequency.

What is claimed is:

1. Apparatus for receiving and passing through pieces of laundry, a piece of laundry being rectangular and comprising a leading edge, a rear edge and two lateral edges, the apparatus comprising a frame and intake means on said frame for engaging a sole corner portion of the leading edge of the piece of laundry which is fed by hand, and conveyor means arranged downstream of said intake means for clamping and conveying said corner portion and the lateral edge portion following said corner portion in a smooth and straightened out condition, independent of the other lateral edge.

2. Apparatus according to claim 1, wherein the intake means comprise orientating means and control means for steering a lateral side following said corner portion of the piece of laundry along a substantially straight line.

3. Apparatus according to claim 2, wherein the apparatus comprises belt conveyor means and a drive mechanism for driving the belt conveyor means, and wherein the orientating means comprise steering rollers and members to bring the steering rollers into contact with the piece of laundry, the steering rollers being actuated by the control means, to pass the piece of laundry through in such a way, that the lateral side of the piece of laundry runs along a substantially straight line after a front edge area of the piece of laundry has been fed into the apparatus.

4. Apparatus according to claim 3, wherein the belt conveyor means comprise front belt conveyor means and rear belt conveyor means, the belt conveyor means being arranged to clamp the piece of laundry, the rear belt conveyor means protruding forwards from below the front belt conveyor means, the rear belt conveyor means comprising a rear endless conveyor belt, wherein engagement means engaging the piece of laundry are placed at the forwardly protruding portion of the rear belt conveyor means.

5. Apparatus according to claim 4, wherein the apparatus comprises clamp placing means to place one or more clamps on the piece of laundry, the clamp placing means comprising a clamp placing unit and clamp control means.

6. Apparatus according to claim 5, wherein the front belt conveyor means comprise a front endless conveyor belt and a front endless insert belt, the front insert belt being placed alongside the front conveyor belt, and the rear endless belt conveyor means comprising a rear endless insert belt, placed alongside the rear conveyor belt, the insert belts being essentially brought into contact with each other in order to guide and to clamp the lateral side of the piece of laundry, the insert belts being shorter than the conveyor belts.

7. Apparatus according to claim 6, wherein the clamp placing unit is placed where the endless insert belts diverge and wherein the clamp control means comprise a clamp photocell to sense the piece of laundry and to activate the clamp placing unit.

8. Apparatus according to claim 7, wherein the clamp placing unit comprises a buffer rail with clamps, and a pivotable arm to fetch a clamp, while opening the clamp, and wherein the clamp photocell actuates the pivotable arm to move the clamp along a path and to place the clamp onto the lateral edge of the piece of laundry.

9. Apparatus according to claim 8, wherein the clamp placing unit comprises a pneumatic cylinder for pivoting the pivotable arm, and comprises a pneumatic cylinder for opening and closing the clamp.

10. Apparatus according to claim 6, wherein two guide plates are placed between the insert belts and the path of the clamps to guide the edge of the piece of laundry.

11. Apparatus according to claim 10, wherein blower means are provided adjacent to the guide plates to establish an air current to keep the edge of the piece of laundry stretched.

12. Apparatus according to claim 4, wherein said engagement means comprises at least one pressure roller, resting on the rear conveyor belt to press a front edge area, and areas of the piece of laundry following said front edge area, onto the forwardly protruding portion of the rear conveyor belt.

13. Apparatus according to claim 12, wherein said engagement means comprises at least one pressure roller, resting on the rear conveyor belt to press a front edge area spaced from the vortex of the corner, and areas of the piece of laundry following said front edge area, onto the forwardly protruding portion of the rear conveyor belt.

14. Apparatus according to claim 3, wherein the intake means comprises a loading table with a front edge, having placed therein a right-hand rear steering roller and a left-hand rear steering roller, a right-hand front steering roller and a left-hand front steering roller, the right-hand and the left-hand steering rollers being positioned opposite each other in pairs and the front steering rollers being suspended and liftable independently from the rear steering rollers, and each pair of steering rollers defining an equal but opposite angle in relation to the perpendicular on the longitudinal direction of the belt conveyor means, and wherein the control means comprises an edge photocell and command means for commanding the steering rollers.

15. Apparatus according to claim 14, wherein the edge photocell is arranged adjacent to the rollers in the loading table, where the side of the piece of laundry will run, in front of the protruding portion of the rear belt conveyor means, and actuates the command means to cause a pair of rollers to cover the edge photocell again with the edge of the piece of laundry if the edge photocell is not covered and to cause the other pair of rollers not to cover the edge photocell again with the edge of the laundry if the edge photocell is covered.

16. Apparatus according to claim 15, wherein the command means comprises a left-hand electromagnet with compression spring for the left-hand pair of steering rollers and a right-hand electromagnet with compression spring for the right-hand pair of steering rollers and pressure means for the front steering rollers, the edge photocell alternately opening the right-hand pair of steering rollers and the left-hand pair of steering rollers during intake of the piece of laundry, by means of the respective electromagnets.

17. Apparatus according to claim 16, wherein the electromagnets with compression spring are arranged onto the rear steering rollers.

18. Apparatus according to claim 16, wherein at least one activating photocell is placed in the loading table to start the belt conveyor means when the activating photocell is covered if the edge photocell is also covered.

19. Apparatus according to claim 18, wherein the activating photocell actuates the pressure means to lift the front steering rollers when the activating photocell is no longer covered by the piece of laundry.

20. Apparatus according to claim 18, wherein the intake means guide the side of the piece of laundry after the at least one activating photocell has been covered for a certain, pre-settable time.

21. Apparatus according to claim 18, wherein two activating photocells spaced sideways from one another are placed in the loading table to start the belt conveyor means when the activating photocells are covered if the edge photocell is also covered.

22. Apparatus according to claim 14, wherein the opposite angles of the respective pairs of steering rollers with regard to the perpendicular on the longitudinal direction of the belt conveyor means are between about 0° and 45°.

23. Apparatus according to claim 22, wherein the opposite angles are about 25°.

24. Apparatus according to claim 14, wherein near the front edge of the loading table a forwardly protruding curved guide rod is placed for smoothing the creases present in the piece of laundry, which rod is attached to the loading table and protrudes sidewards beyond the rear conveyor belt at that side of the loading table which is opposite the side of the loading table where the lateral edge of the piece of laundry will move.

25. Apparatus according to claim 14, wherein below the loading table, spaced from the piece of laundry's side edge which is to be conveyed, discontinuously operating supporting means are arranged for supporting freely depending portions of the piece of laundry, if the piece of laundry is wider than the belt conveyor means.

26. Apparatus according to claim 25, wherein the supporting means spreads the piece of laundry in sidewards direction.

27. Apparatus according to claim 26, wherein the supporting means comprise a supporting member with one or more spread cams, which move upwards at an oblique angle during operation of the supporting means.

28. Apparatus according to claim 27, wherein the supporting member is a rotatable cam table of which the corners form the spread cams.

29. Apparatus according to claim 28, wherein the cam table is essentially triangular.

30. Apparatus according to claim 28, wherein the cam table, as seen in a plane parallel to the front belt conveyor means, is upwardly inclined under an angle of 15° with regard to the horizontal.

* * * * *

UNITED STATES PATENT AND TRADEMARK OFFICE

CERTIFICATE OF CORRECTION

PATENT NO. : 5,437,114

DATED : August 1, 1995

INVENTOR(S) : Kuipers

It is certified that error appears in the above-identified patent and that said Letters Patent is hereby corrected as shown below:

In column 1, line 10, after "Related", please insert - -Art- -.

Signed and Sealed this

Third Day of October, 1995

Bruce Lehman

*Attest:*

BRUCE LEHMAN

*Attesting Officer*

*Commissioner of Patents and Trademarks*